US006299704B1

(12) United States Patent
Igarashi et al.

(10) Patent No.: US 6,299,704 B1
(45) Date of Patent: Oct. 9, 2001

(54) HEAT RESISTING STEEL CONTAINING A FERRITE OR TEMPERED MARTENSITE STRUCTURE

(75) Inventors: Masaaki Igarashi; Seiichi Muneki, both of Ibaraki (JP)

(73) Assignee: Japan as represented by Director General of National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/384,285

(22) Filed: Aug. 27, 1999

(30) Foreign Application Priority Data

Aug. 31, 1998 (JP) ..... 10-260956

(51) Int. Cl.[7] ..... C22C 38/00; C22C 38/22; C22C 38/24; C22C 38/26; C22C 38/28

(52) U.S. Cl. ..... 148/325; 148/328; 148/333; 420/34; 420/104

(58) Field of Search ..... 420/34, 104; 148/325, 148/328, 333

(56) References Cited

U.S. PATENT DOCUMENTS 4,244,754 * 1/1981 Masumoto et al. ..... 148/12

FOREIGN PATENT DOCUMENTS 3-97832 * 4/1991 (JP) .
4-371551 * 12/1992 (JP) .
4-371552 * 12/1992 (JP) .
5-263196 * 10/1993 (JP) .
5-311342 * 11/1993 (JP) .
5-311343 * 11/1993 (JP) .
5-311344 * 11/1993 (JP) .
5-311345 * 11/1993 (JP) .

* cited by examiner

*Primary Examiner*—Roy King
*Assistant Examiner*—Nicole Coy
(74) *Attorney, Agent, or Firm*—Wenderoth, Lind & Ponack, L.L.P.

(57) ABSTRACT

Heat resisting steel containing a ferrite or tempered martensite structure, in which intermetallic compound phases having a $L1_0$ or $L1_2$ ordered structure are uniformly precipitated in ferrite or tempered martensite grains.

6 Claims, 4 Drawing Sheets

$L1_0$ cell in b. c. c. lattice.

{001} α//{001} α″, <100> α//<110> α″

$L1_0$ cell in b. c. c. lattice.

$\{001\}\alpha // \{001\}\alpha''$, $\langle 100\rangle\alpha // \langle 110\rangle\alpha''$

HEAT RESISTING STEEL CONTAINING A FERRITE OR TEMPERED MARTENSITE STRUCTURE

FIELD OF THE INVENTION

The present invention relates to heat resisting steel. More particularly, the present invention relates to heat resisting steel excellent in creep strength at over 650° C. and with little deterioration of steam oxidation resistance, which is useful for a material for apparatuses operated under high pressure and high temperature over 630° C. which has been thought to be a critical temperature of conventional ferritic steel. The heat resisting steel of the present invention is especially useful for steel pipes provided for heat exchanging boilers, steel sheets for pressure vessels, or a turbine material.

DESCRIPTION OF THE PRIOR ART

Boilers and turbines for electric power generation, nuclear power plants, or chemical industrial apparatuses are used under high temperature and high pressure for a long time. Heat resisting steel adopted to these apparatuses is required to be excellent in strength, corrosion resistance, oxidation resistance under high temperature and ductility under room temperature. For such heat resisting steel, austenitic stainless steel such as JIS-SUS321H and JIS-SUS347H, low alloy steel such as JIS-STBA24(2·1/4Cr-1Mo) and high chromium ferritic steel such as JIS-STBA26(9Cr-1Mo) have been utilized. High chromium ferritic steel is more excellent than low alloy steel in strength and corrosion resistance at temperature range of 500~650° C. High chromium ferritic steel also has several strong points compared with austenitic stainless steel, that is, lower price, higher coefficient of heat conductivity, and smaller coefficient of thermal expansion. Besides, high chromium ferritic steel is excellent in thermal stress resistance and has attractive properties that scale peeling is not likely to occur and that stress corrosion cracking does not happen.

With regard to thermal power generation, increase of both steam temperature and pressure of a boiler has been promoted in order to improve thermal efficiency of a boiler. Conversion from a supercritical pressure condition of 538° C. and 246 atmosphere to an extra supercritical pressure condition of 650° C. and 350 atmosphere is now being planned. According to the change of a steam condition, required properties for boiler steel pipes are severer and therefore it has been difficult for high chromium ferritic steel to meet several requirements such as long time creep strength, oxidation resistance, and, especially, steam oxidation resistance. Steam oxidation is an oxidizing phenomenon at the surface of boiler pipes exposed to steam with high temperature and high pressure. When oxide films as a scale are formed, they peels off according to the change of boiler temperature. Since a scale after peeling clogs steel pipes, suppression of steam oxidation is one of the most important problems to be solved.

Some austenitic stainless steel which meets the requirement only for steam oxidation resistance has been developed, but this is not available to steam plumbing with large diameter and large thickness because the austenitic stainless steel has several defects in ductility and in both thermal stress resistance and thermal shock resistance against thermal distortion based on the operating schedule of the power plant. Other scientific efforts have been made, in which critical temperature is increased by improving properties of high chromium ferritic steel.

As a result of them, heat resisting steel has been obtained by adding tungsten(W) to the conventional high chromium ferritic steel. The Japanese patent provisional publication 3-97832 discloses that large amount of W is added to high chromium ferritic steel and that copper(Cu) is also added to improve oxidation resistance at high temperature. The Japanese patent provisional publications 4-371551 and 4-371552 propose high chromium ferritic steel with both increased strength at high temperature and ductility by adding W and molybdenum(Mo) in suitable ratios together with cobalt(Co) and boron(B).

These kinds of high chromium ferritic steel above-mentioned include so large amount of W that they are excellent in creep strength at high temperature. W as well as Mo and chromium(Cr) is, however, one of the constituent elements for ferrite. When the amount of W is excessively large, δ-ferrite is formed in steel, resulting in deterioration of ductility.

A martensite single phase is effective for preventing from deteriorating ductility. The Japanese patent provisional publication 5-263196 discloses that a martensite single phase is formed in heat resisting steel with small amount of Cr. The Japanese patent provisional publications 5-311342, 5-311343, 5-311344, 5-311345, and 5-311346 propose high chromium ferritic steel with increased ductility, which is realized by adding constituent elements for austenite such as nickel(Ni), Cu, and Co.

The high chromium ferritic steel disclosed in the Japanese patent provisional publication 5-263196, however, has a defect in that steam oxidation resistance is not sufficient because Mo and Ni destroy fine and stable scale layers formed on the surface of steel which consist of $Cr_2O_3$ characterized as a corundum type. With regard to the high chromium ferritic steel disclosed such as in the Japanese patent provisional publication 5-311342, since the steel includes a large amount of Ni and Cu, both $A_1$ and $A_3$ transformation temperatures are low and therefore resistance to temper softening is so small that long time creep strength is low. Inclusion of Ni and Cu also changes the structure of oxides such as $Cr_2O_3$, this leading to deterioration of steam oxidation resistance of high chromium ferritic steel.

As above-mentioned, the conventional high chromium ferritic steel has a serious defect in that long time creep strength at over 600° C. is low. This is primarily because strengthening mechanisms brought by a ferritic matrix phase, a carbide of $M_{23}C_6$ or $M_6C$, a carbo-nitride of MX, and an intermetallic compound such as a Laves phase, which are precipitated in a final stable structure, are deteriorated at high temperature.

Strengthening in a martensite lath grain, or strengthening both a former austenite grain boundary and a martensite lath interface is considered in order to improve creep strength of ferritic steel with the structure above-mentioned. It has been thought that stabilization by MX is effective for the former and that $M_{23}C_6$ and Laves phase are effective for the latter. According to the idea, several alloys have been designed. However, no steel with remarkably increased creep resistance at high temperature has been actually obtained up to now.

The present invention has an object to overcome the limit of the conventional technology and to provide heat resisting steel excellent in a long time creep property even at over 650° C.

This and other objects, features and advantages of the invention will become more apparent upon a reading of the following detailed specification and drawings, in which:

DETAILED DESCRIPTION OF THE INVENTION

Figure 1:
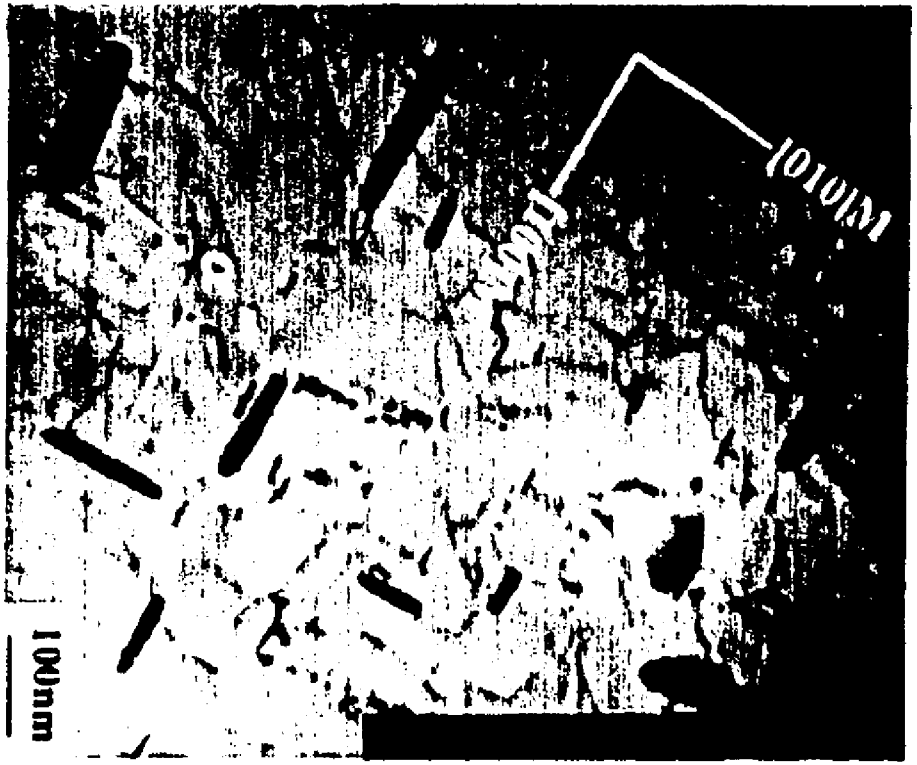
FIG. 1 is a transmission electric microscope image showing ordered phases with a planar shape.

The present invention provides heat resisting steel comprising a ferrite or tempered martensite structure, in which intermetallic compound phases having a $L1_0$ $L1_2$ ordered structure are uniformly precipitated in ferrite or tempered martensite grains.

The present invention also provides the heat resisting steel which includes, in chemical compositions, chromium(Cr) in amount of 8.0~15.0 wt % and at least one element selected from the group consisting of palladium(Pd) and platinum (Pt), the amount of which is regulated by Pd+(1/2)Pt and 0.1 wt %≦Pd+(1/2)Pt≦5.0 wt %.

The present invention also provides the heat resisting steel which has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~5.0 wt % and platinum (Pt) in amount of 0~10.0 wt %, the amount of which is also regulated by Pd+(1/2)Pt and 0.1 wt %≦Pd+(1/2)Pt≦5.0 wt %; and the rest being iron(Fe) and inevitable impurities.

The present invention further provides the heat resisting steel which has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of cobalt(Co) in amount of 0.1~1.5 wt %, nickel(Ni) in amount of 0.1~1.5 wt %, copper(Cu) in amount of 0.1~1.5 wt %, rhodium(Rh) in amount of 0.2~3.0 wt %, silver(Ag) in amount of 0.2~3.0 wt %, iridium(Ir) in amount of 0.2~3.0 wt %, gold(Au) in amount of 0.2~3.0 wt %, the amount of which is also regulated by Pd+(1/2)Pt+2Co+2Ni+2Cu+Rh+Ag+(1/2)Ir+(1/2)Au and 1.0 wt %≦Pd+(1/2)Pt+2Co+2Ni+2Cu+Rh+Ag+(1/2)Ir+(1/2)Au≦3.0 wt %; and the rest being iron(Fe) and inevitable impurities.

The present invention further provides the heat resisting steel which has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.01 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of gallium(Ga) in amount of 0.05~1.0 wt %, indium(In) in amount of 0.1~1.5 wt %, and thallium(Tl) in amount of 0.2~3.0 wt %, the amount of which is also regulated by 2Ga+In+(1/2)Tl and 0.1 wt %≦2Ga+In+(1/2)Tl≦1.5 wt %; and the rest being iron(Fe) and inevitable impurities.

The present invention further provides the heat resisting steel which has a chemical composition consisting essentially of carbon(C) in amount of 0.06~0.1 8 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of cerium(Ce) in amount of 0.01~0.20 wt %, praseodymium(Pd) in amount of 0.01~0.20 wt %, neodymium(Nd) in amount of 0.01~0.20 wt %, promethium(Pm) in amount of 0.01~0.20 wt %, and samarium(Sm) in amount of 0.01~0.20 wt %, the amount of which is also regulated by Ce+Pr+Nd+Pm+Sm and 0.01 wt %≦Ce+Pr+Nd+Pm+Sm≦0.20 wt %; and the rest being iron(Fe) and inevitable impurities.

The inventors of the present invention have particularly studied the relationship between several properties of high chromium ferritic steel, i.e., long creep strength at high temperature, steam oxidation resistance, and both chemical compositions of steel and metal structures as a microstructure for the purpose of developing heat resisting steel with remarkably improved long time creep strength while maintaining steam oxidation resistance at over 650° C. The present invention has been accomplished based on quite unique knowledge found in the study.

① The metal structure of high chromium ferritic steel is a tempered martensite structure in which carbo-nitride is precipitated by a normalizing and tempering process. The tempered martensite structure is a starting structure by which initial strength of high chromium ferritic steel is determined. However, when high chromium ferritic steel is used at over 630° C., the tempered martensite structure is so softened by recovery with time that creep strength cannot be maintained.

② The final stable structure of high chromium ferritic steel is composed of a ferritic matrix phase, a carbide expressed by a formula $M_{23}C_6$(M: Cr, Fe, Mo, W) or $M_6C$(W and Mo are more condensed compared with $M_{23}C_6$), which is precipitated mainly along both a former austenite grain boundary and a martensite lath interface, a carbo-nitride expressed by a formula MX(M: Ti, Zr, Hf, V, Nb, Ta; X:C, N), which is precipitated in lath grains, a former austenite grain boundary, a martensite lath interface, and an intermetallic compound such as a Laves phase, which is partially precipitated in lath grains. It is desirable for maintaining long time creep strength that these precipitates are stable and are not agglomerated even at high temperature and for a long time.

③ As above-mentioned, it has been considered that MX is effective for strengthening in a martensite lath grain and that stabilization of both $M_{23}C_6$ and Laves phase is effective for strengthening both a former austenite grain boundary and a martensite lath interface.

④ On the contrary, it is found by the inventors that fine precipitation of an intermetallic compound with a $L1_0$ or $L1_2$ ordered structure is quite effective for strengthening inside of a grain. Some kinds of $L1_0$ or $L1_2$ intermetallic compounds are uniformly precipitated in a martensite(ferrite) lath grain with the relationship of a crystallographic direction against a martensite(ferrite) matrix phase, such as $\{001\}\alpha//\{001\}L1_0$ or $L1_2$, or $<100>\alpha//<110>L1_0$ or $L1_2$. In the case of a $L1_0$ structure, owing to a face centered tetragonal crystal structure, an intermetallic compound phase is precipitated with coherency or semi-coherency of a matrix phase lattice in the direction of a-axis and with non-coherence in the direction of c-axis. On the other hand, in the case of a $L1_2$ structure, morphology is like a plate along a {001} plane of a matrix phase, which is based on difference in lattice constants between a matrix phase and a precipitated one. See transmission electron microscope image of FIG. 1, for example. The image relates to a specimen of No.5 in the following table and a $L1_0$ precipitated phase is shown in the image.

⑤ The most difference between a precipitated phase (hereafter α" phase) with a $L1_0$ or $L1_2$ ordered structure and a Laves, $\mu$, $\chi$, or σ phase is that a α" phase is uniformly precipitated in a lath grain. On the other hand, a Laves, $\mu$,$\chi$, or σ phase is preferentially precipitated in a former austenite grain boundary and a martensite lath interface.

⑥ It is confirmed that creep resistance over 650° C. of heat resisting steel in which a α" phase is precipitated is remarkably improved as compared with the conventional heat resisting steel.

⑦ It is also confirmed that, in spite of precipitation of a α" phase, steam oxidation resistance is not deteriorated over 650° C., but is rather improved.

In heat resisting steel of the present invention, an intermetallic compound with a $L1_0$ or $L1_2$ ordered structure is uniformly precipitated in a grain of a ferrite or tempered martensite structure. $L1_0$ and $L1_2$ ordered structure can be distinguished as such in an electron beam diffraction image obtained by observation with an electron microscope.

Uniform precipitation of an α" phase has never been known and the fact that a superlattice of a face centered cubic(f.c.c) is coherently precipitated in a matrix phase of a body centered cubic(b.c.c) with the relationship of a crystallographic direction such as $\{001\}\alpha//\{001\}L1_0$ or $L1_2$, or $<100>\alpha//<110>L1_0$ or $L1_2$ should be attractive.

Figure 2:
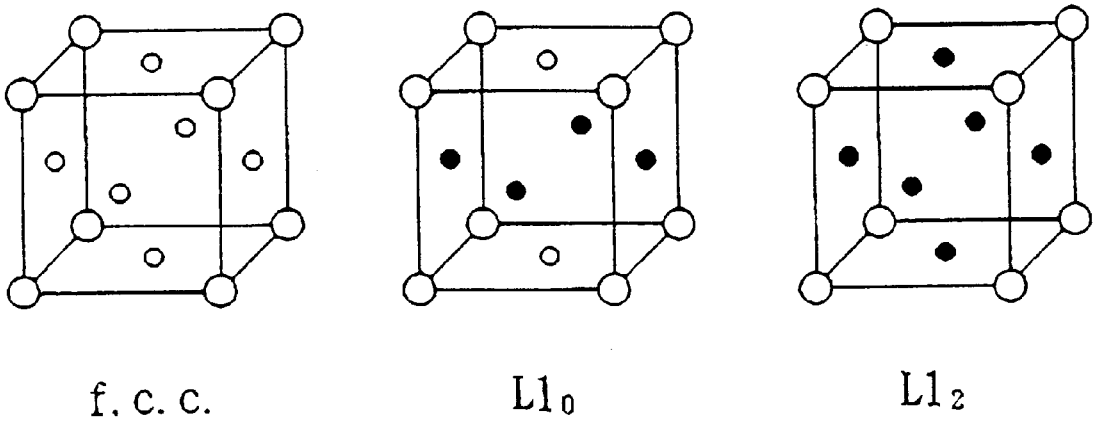
FIG. 2 illustrates $L1_0$ and $L1_2$ ordered structures together with a face-centered cubic(f.c.c) structure.
Figure 3:
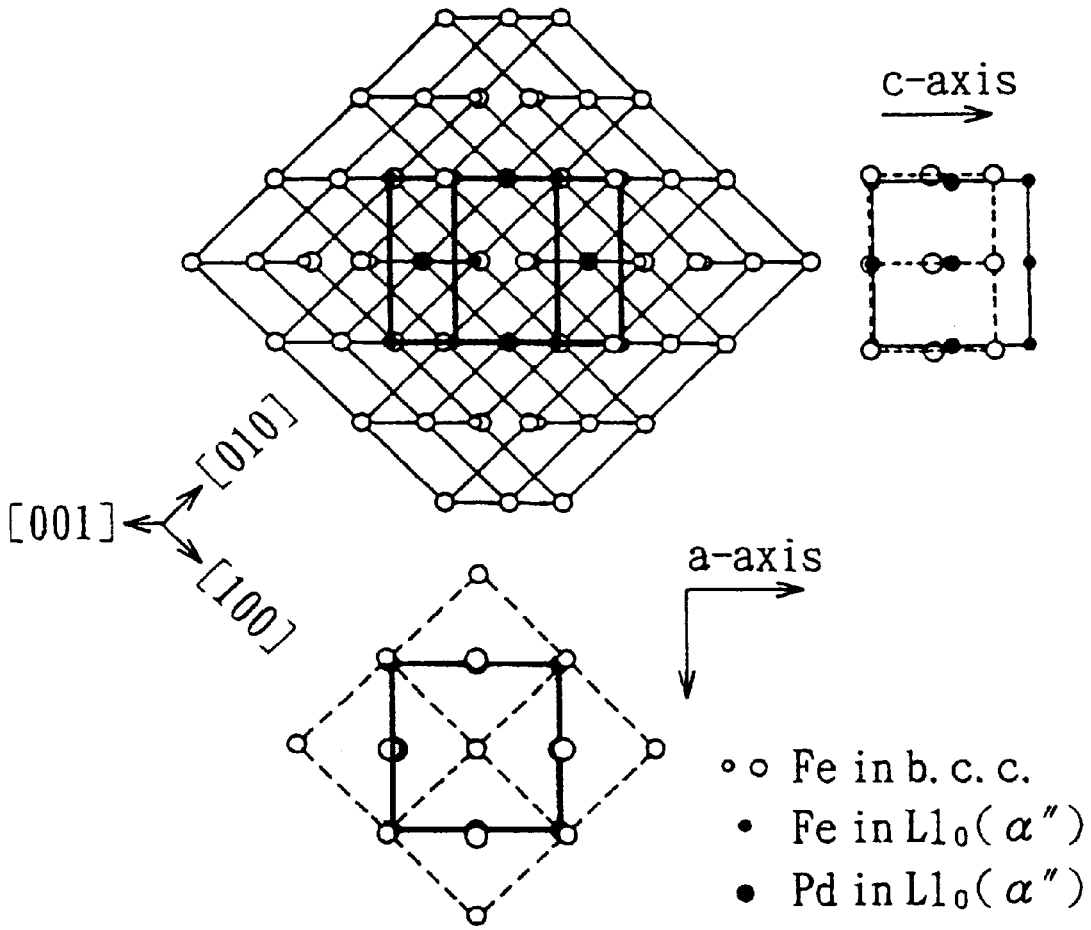
FIG. 3 illustrates a $L1_0$ ordered structure as an embodiment including palladium(Pd)

Black circles shown in FIG. 2 which illustrates f.c.c., $L1_0$, and $L1_2$ structures show an Pd or Pt atom. A $L1_0$ structure with Pd is illustrated in FIG. 3.

Precipitation of a α" phase is realized by chemical compositions which include Cr in amount of 8.0~15.0 wt % and at least one element selected from the group consisting of Pd and Pt, the amount of which is regulated by Pd+(1/2)Pt and 0.1 wt % ≦Pd+(1/2)Pt≦5.0 wt %. Several modifications of chemical compositions are above-mentioned.

The reason for the ratio of each element is as follows:

Cr: Chromium(Cr) is an inevitable element for maintaining both corrosion resistance and oxidation resistance, especially, steam oxidation resistance. An elaborate oxide film, which is made of chromium oxide, is formed on the surface of steel. Such properties at high temperature as corrosion resistance and oxidation resistance including steam oxidation resistance are improved by the oxide film. Cr also forms carbide and the carbide improves creep strength of steel. In order to realize these effects, the amount of chromium in steel is 8.0 wt % or more. When the amount is over 15.0 wt %, ductility of steel is deteriorated because δ-ferrite is apt to be formed.

Pd: Palladium(Pd) is an element for promoting precipitation with uniform dispersion of an intermetallic compound phase with a $L1_0$ or $L1_2$ ordered structure, i.e., a α" phase. The effect of Pd is remarkable in the case of the amount of 0.1 wt % or more. Pd in steel has been thought to severely deteriorate $A_1$ transformation temperature, but it is found that, in high chromium ferritic steel including molybdenum (Mo) and tungsten(W), both deterioration of $A_1$ transformation temperature, and agglomeration of carbo-nitride are sufficiently suppressed and therefore long time creep strength is not deteriorated at temperature over 650° C. The effect is, however, saturated when the amount of Pd is 5 wt %. Consequently, the amount of Pd is 0~5 wt %.

Pt: Platinum(Pt) as well as Pd is an element for promoting precipitation with uniform dispersion of an intermetallic compound phase with a $L1_0$ or $L1_2$ ordered structure, i.e., a α" phase. Improvement of creep resistance obtained by Pt is greater than that of Pd, which is derived from difference in matching distortion between a matrix phase and a α" phase. Pt in steel has also been thought to severely deteriorate $A_1$transformation temperature, but it is found that, in high chromium ferritic steel including molybdenum(Mo) and tungsten(W), deterioration of $A_1$ transformation temperature is not severe and agglomeration of carbo-nitride is perfectly suppressed. As a result, long time creep strength is not deteriorated at temperature over 650° C. Addition of Pt in a large amount of over 10 wt % is not required. The amount of Pt is 0~10.0 wt %.

Above all, with regard to Pd and Pt, a prescribed effect is obtained in the case of 0.1 wt %$\leqq$Pd+(1/2)Pt$\leqq$5.0 wt %. This can be equally said both in the case of only one element, i.e., either Pd or Pt, and in the case of these two elements.

C: Carbon(C) is an element for forming austenite and suppresses a δ-ferrite phase. C is also an inevitable element both for remarkably improving hardenability of steel and for forming martensite matrix phase. Further, C forms MC(M is an alloy element such as V, Nb, Ta, Ti, Zr, Hf, in some case, MC is modified to MX carbo-nitride (M is the same element as in MC; X: C and N)), $M_7C_3$(M is an alloy element such as Cr, Fe, Mo, W), $M_{23}C_6$(M is the same element as in $M_7C_3$), or $M_6C$. These carbides remarkably improve properties of steel. As a result of normalizing and tempering, the structure of high chromium ferritic steel is usually tempered martensite. When steel is used for a long time at high temperature over 630° C., precipitation of fine carbides such as MX is accelerated. The carbides have a function of maintaining long time creep strength. In order to obtain this effect of carbide, the amount of C is 0.06 wt % or more. When the amount of C exceeds 0.18 wt %, agglomeration of carbides occurs from the initial stage under high temperature and therefore long time creep strength is deteriorated. Consequently, the amount of C is 0.06~0.18 wt %.

Si: Silicon(Si) is used as a deoxidizer for molten steel. Si is also effective for improving steam oxidation resistance under high temperature. The amount of Si is preferably 1 wt % or less because the excessive amount of Si causes ductility of steel to be deteriorated. If molten steel is deoxidized by the sufficient amount of aluminum(Al), Si may be excluded from steel.

Mn: Manganese(Mn) has been added to secure sulfur(S) as MnS and improve hot working property, but Mn is not necessarily added in the sufficiently desulfurized steel. In the steel of the present invention, addition of Mn is optional because Mn has an effect for improving short time creep strength under high stress. When the amount of Mn exceeds 1.5wt %, ductility of steel is deteriorated. Consequently, the amount of Mn is 0~1.5 wt %.

P and S: Both phosphorus(P) and sulfur(S) are included as an inevitable impurity in steel of the present invention and they influence both ductility of the welded portion and hot working. Consequently, the amount of P and S is as little as possible. The amount of P is preferable 0.030 wt % or less and the amount of S 0.015 wt % or less.

W: Tungsten(W) is one of the effective elements for improving creep strength. W, in solid solution, strengthens a martensite matrix phase. When steel is used at high temperature, W also forms intermetallic compounds including $\mu$ phase of $Fe_7W_6$ or Laves phase of $Fe_2W$ and improves long time creep strength in the form of a finely precipitated phase. Further, W is effective for maintaining strength at high temperature because W, in solid solution, exists in Cr carbides such as $M_{23}C_6$ and suppresses agglomeration of carbides. Solid solution strengthening is remarkable in the slight amount of W and precipitation strengthening remarkable in the case of over 1 wt %. In the amount of over 4.0 wt %, δ-ferrite is apt to be formed and therefore ductility is deteriorated. When molybdenum(Mo) is added together with W, it is preferable that the amount formulated by W+2Mo is 4.0 wt % or less. If steel is strengthened by another strengthening element, W is not always necessary.

Mo: Molybdenum(Mo) as well as W contributes to solid solution strengthening in the slight amount and precipitation strengthening in the amount of over 1 wt %. Creep strength is improved in the both cases. On the other hand, temperature range where precipitation strengthening occurs is lower, i.e., 600° C. or lower, than that of W. Mo is also effective for preserving long time creep strength because $M_{23}C_6$ or $M_7C_3$ carbide including Mo is stable at high temperature. In the amount of over 2.0 wt %, δ-ferrite is apt to be formed and therefore ductility is deteriorated. When W is added together with Mo, it is preferable that the amount formulated by W+2Mo is 4.0 wt % or less. If steel is strengthened by another strengthening element, Mo is not always needed.

V: Vanadium(V) forms fine carbo-nitrides and contributes to improvement of creep strength. The effect of V is exhibited in the amount of 0.10 wt % or more, but is saturated in the amount of over 0.50 wt %. The amount of V is therefore 0.10~0.50 wt %.

Nb: Niobium(Nb), in the form of nitrides or carbo-nitrides, improves strength and ductility of steel. In order to obtain these effects, Nb is required to be 0.03 wt % or more. However, the effect is saturated in the case of over 0. 14 wt %. The amount of Nb is reasonable to be 0.03~0.14 wt %.

Ta: Tantalum(Ta) as well as Nb, in the form of nitrides or carbo-nitrides, improves strength and ductility of steel even in the slight amount. When the amount of Ta exceeds 0.30 wt %, the effect is saturated. Therefore, the amount of Ta is reasonable to be 0~0.30 wt %.

Ti, Zr and Hf: Titanium (Ti), zirconium(Zr) and hafnium (Hf) are more effective elements for forming nitrides or carbo-nitrides than Nb and Ta. They improve strength and ductility of steel in the slight amount and also improve creep resistance at high temperature because they contribute to grain boundary strengthening. These effects are saturated when the amount of Ti is over 0.15 wt %, the amount of Zr is over 0.30 wt %, or the amount of Hf is over 0.60 wt %.

Therefore, the amount of Ti, Zr and Hf is reasonable to be 0~0.15 wt %, 0~0.30 wt %, and 0~0.60 wt %, respectively.

N: Nitrogen(N) as well as carbon(C) is an important austenite forming element which serves for suppressing a δ-ferrite phase and is also an element which improves hardenability of steel so much that martensite is formed. It is, on the other hand, important to control the adding ratio of C and N in the light of a prescribed property. In steel of the present invention, when a δ-ferrite phase is sufficiently suppressed by C, Pd and Pt and creep strength over 650° C. is particularly required, addition of N in a large amount is not always needed. Addition of N is preferable when improvement of hardenability and suppression of a δ-ferrite phase are required. Even in this case, however, ductility is deteriorated in case that agglomeration of nitrides is promoted by a large amount of N. Consequently, the amount of N is 0~0.10 wt %.

B: The slight amount of boron(B) improves long time creep strength at high temperature because carbides, mainly $M23C_6$, are so finely dispersed and precipitated that agglomeration is suppressed. When cooling rate of a thick material after heat treatment is slow, for example, B improves strength at high temperature as well as hardenability. The steel of the present invention does not necessarily contain B, but can contain B for the purpose of improving strength at high temperature. The effect of B is remarkable in the amount of 0.0005 wt % or more. In the case of the amount of over 0.030 wt %, ductility is deteriorated by the formation of bulky precipitates. In this sense, the upper limit of the amount of B is 0.03 wt %.

O: Oxygen(O) is involved in steel as an inevitable impurity. When bulky oxides are omnipresent in steel, ductility is influenced. In order to particularly maintain ductility, the amount of O is as little as possible. The upper limit of the amount of O is 0.020 wt % because influence on ductility is little in the case of the amount of 0.020 wt % or less.

sol. Al: Aluminum(Al) is added as a main deoxidizer of molten steel. Al exists in steel in the form of two types; one is an oxide and the other except the oxide. From the viewpoint of analysis, the latter is distinguished as Al with solubility in hydrochloric acid, i.e., sol. Al. The amount of sol. Al is required to be 0.001 wt % in order to obtain a deoxidization effect. On the other hand, sol. Al in amount of over 0.050 wt % leads to deterioration of creep strength. Sol. Al is not always needed if deoxidization of molten steel is possible with another manner. Consequently, the amount of sol. Al is 0.050 wt % or less.

In the present invention, the amount of Pd and Pt can be reduced to 0.1 wt %≦Pd+(1/2)Pt≦1.0 wt %, but in place of Pd and Pt, another additive elements are needed.

Another additive elements are, as an embodiment, at least one element selected from the group consisting of cobalt (Co) in amount of 0.1~1.5 wt %, nickel(Ni) in amount of 0.1~1.5 wt %, copper(Cu) in amount of 0.1~1.5 wt %, rhodium(Rh) in amount of 0.2~3.0 wt %, silver(Ag) in amount of 0.2~3.0 wt %, iridium(Ir) in amount of 0.2~3.0 wt %, gold(Au) in amount of 0.2~3.0 wt %. The amount of them is also regulated by Pd+(1/2)Pt+2Co+2Ni+2Cu+Rh+Ag+(1/2)Ir+(1/2)Au and 1.0 wt %≦Pd+(1/2)Pt+2Co+2Ni+2Cu+Rh+Ag+(1/2)Ir+(1/2) Au and 1.0 wt≦Pd+(1/2)Pt+2Co+2Ni+2Cu+Rh+Ag+(1/2)Ir+(1/2)Ir+(1/2)Au≦3.0 wt %.

As another embodiments, another additive elements are at least one element selected from the group consisting of gallium(Ga) in amount of 0.05~1.0 wt %, indium(In) in amount of 0.1~1.5 wt %, and thallium(Tl) in amount of 0.2~3.0 wt %.

The amount of them is also regulated by 2Ga+In+(1/2)Tl and 0.1 wt %≦2Ga+In+(1/2)Tl≦1.5 wt %.

As further another embodiments, another additive elements are at least one element selected from the group consisting of cerium(Ce) in amount of 0.01~0.20 wt %, praseodymium(Pd) in amount of 0.01~0.20 wt %, neodymium(Nd) in amount of 0.01~0.20 wt %, promethium (Pm) in amount of 0.01~0.20 wt %, and samarium(Sm) in amount of0.01~0.20 wt %. The amount of them is also regulated by Ce+Pr+Nd+Pm+Sm and 0.01 wt %≦Ce+Pr+Nd+Pm+Sm≦0.20 wt %.

Co, Ni, Cu, Rh, Ag, Ir and Au: Both Pd and Pt are, as above-mentioned, effective for uniformly dispersing and precipitating a α" intermetallic compound phase with a $L1_0$ or $L1_2$ ordered structure. Co, Ni, Cu, Rh, Ag, Ir or Au can be partially substituted for Pd and Pt. The effect of substitution of these additive elements is remarkable in the case that at least one element selected from the group consisting of Co in amount of 0.1~1.5 wt %, Ni in amount of 0.1~1.5 wt %, Cu in amount of 0.1~1.5 wt %, Rh in amount of 0.2~3.0 wt %, Ag in amount of 0.2~3.0 wt %, Ir in amount of 0.2~3.0 wt %, and Au in amount of 0.2~3.0 wt % is contained. When the additive elements are added in combination of Pd in amount of 0.1~1.0 wt %, Pt in amount of 0.2~2.0 wt % or both, the amount of them is regulated by Pd+(1/2)Pt+2Co+2Ni+2Cu+Rh+Ag+(1/2)Ir+(1/2)Au and 1.0 wt %≦Pd+(1/2)Pt+2Co+2Ni+2Cu+Rh+Ag+(1/2)Ir+(1/2)Au≦3.0 wt %.

Ga, In and Ti: Even in a small amount of Pd and Pt, addition of Ga, In or Tl is effective for uniformly dispersing and precipitating a α" intermetallic compound phase with a $L1_0$ or L12 ordered structure. The effect is remarkable in the case that at least one element selected from the group consisting of Ga in amount of 0.05~1.0 wt %, In in amount of 0.1~1.5 wt %, and Tl in amount of 0.2~3.0 wt % is contained. The amount of them is also regulated by 2Ga+In+(1/2)Tl and 0.1 wt %≦2Ga+In+(1/2)Tl≦1.5 wt %. In this case, a prescribed property of steel is obtained even by addition of Pd in amount of 0.1~1.0 wt %, Pt in amount of 0.2~2.0 wt % or both and 0.1 wt %≦Pd+(1/2)Pt≦1.0 wt %.

Ce, Pr, Nd, Pm and Sm: Ce, Pr, Nd, Pm or Sm promotes to uniformly disperse and precipitate a α" phase. The effect is remarkable in the case that at least one element selected from the group consisting of Ce in amount of 0.01~0.20 wt %, Pd in amount of 0.01~0.20 wt %, Nd in amount of 0.01~0.20 wt %, Pm in amount of 0.01~0.20 wt %, and Sm in amount of 0.01~0.20 wt % is contained. The amount of them is also regulated by Ce+Pr+Nd+Pm+Sm and 0.01 wt %≦Ce+Pr+Nd+Pm+Sm≦0.20 wt %. In this case, a prescribed property of steel is obtained even by addition of Pd in amount of 0.1~1.0 wt %, Pt in amount of 0.2~2.0 wt % or both and 0.1 wt %≦Pd+(1/2)Pt≦1.0 wt %.

The heat resisting steel of the present invention, of which chemical compositions are above-mentioned, can be produced by apparatuses and process which are usually used in industry. For example, refining can be conducted in a furnace such as an electric furnace or a converter. Constituent control can be performed by addition of a deoxidizer and alloy elements. When strict constituent control is required, vacuum treatment can be adapted to molten steel before adding alloy elements.

Molten steel with a controlled and prescribed composition is cast into slab, billet or steel ingot. Steel pipes or plates are made from the slab, billet or steel ingot. For example, seamless steel pipes can be made by extrusion or forging of billet. Steel plates can be made as a hot rolled steel plate by hot rolling of slab. Cold rolled steel plates can be made by cold rolling of the hot rolled steel plates obtained. Properties of the steel pipes or plates can be controlled by heat treatment such as annealing if necessary. When cold working such as cold rolling after hot working is adopted, annealing and acid pickling are usually conducted before the cold working.

Now, the present invention will be described more in detail by way of examples.

EXAMPLES

Table 1 shows compositions of the specimens which were put to the property tests. Specimens Nos. 1 and 2 were conventional high chromium ferritic steel. The composition of specimen No. 1 is regulated in ASTM-A213-T91 and the composition of specimen No.2 in DIN-X20CrMoWV121. The other specimens were steel of the present invention. Table 2 shows the results of the tests.

A making process adopted to each of the specimens was as follows:

First of all, raw materials were molten in a vacuum high frequency induction furnace with capacity of 10 kg. After adjustment of a prescribed chemical composition, the molten steel was cast into a steel ingot. A specimen which had a square section with a side of 45 mm and a length of 400 mm was made from the steel ingot by hot forging at 1250~1000° C. The specimen was subsequently hot-rolled at 100~900° C. and formed into the shape which had a square section with a side of 15 mm. Then, the following heat treatments were conducted:

With regard to specimens Nos. 1 and 2, a usual heat treatment was performed. Normalizing in air after preserving at 950° C. for an hour and tempering in air after preserving at 750° C. for an hour were adopted to the specimens Nos. 1 and 2. With regard to the other specimens, normalizing in air after preserving at 1100°C. for an hour and tempering in air after preserving at 800° C. for an hour were adopted to the specimens. A test piece for testing steam oxidation resistance and for high temperature creep strength was cut from the heat-treated specimen.

The manners of evaluating both steam oxidation resistance and high temperature creep strength are as follows:

[Steam Oxidation Resistance]

Steam oxidation resistance was evaluated by a steam oxidation test under the following test condition:

| | |
|---|---|
| Atmosphere: | Steam, 650° C. |
| Holding time: | 1000 hours |
| Measurement object: | Thickness of scale |

[High Temperature Creep Strength]

High temperature creep strength was evaluated by a creep rupture test under the following test condition:

| | |
|---|---|
| Test piece: | 8.0 mm diameter, Distance between gage marks: 40 mm |
| Temperature: | (1) 650° C., (2) 700° C. |
| Stress: | (1) 120 MPa, (2) 120 Mpa |
| Measurement object: | Creep rate-time chart, creep rupture time |

Figure 4:
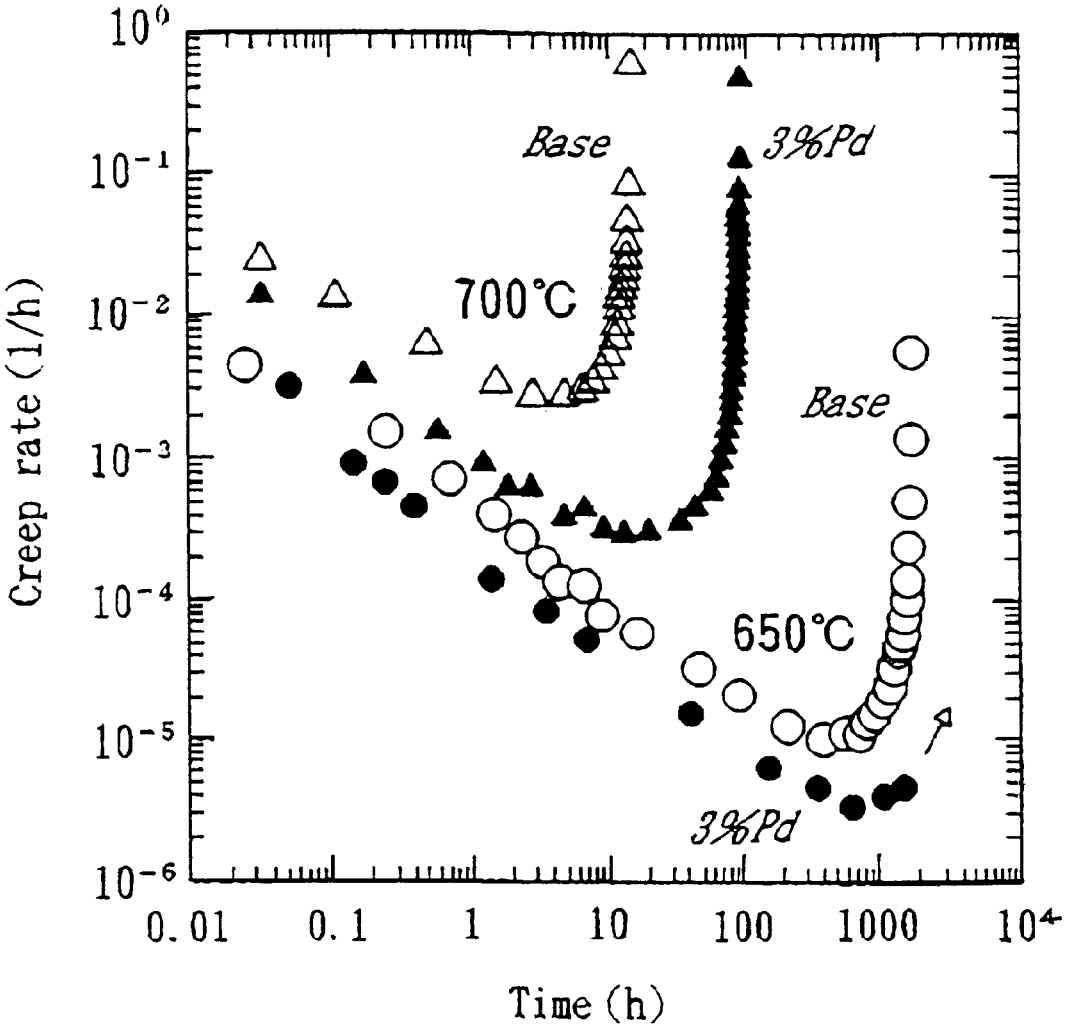
FIG. 4 illustrates a creep rate-time chart at each of 650° C. and 700° C.

As shown in Table 2, with regard to the specimens Nos. 3~16 as an embodiment of the present invention, creep rupture time was 3000 hours or longer at 650° C. and 120 MPa and was 100 hours or longer at 700° C. and 120 MPa in every case. Creep strength is much improved as compared with the conventional steel. Especially, decrease of a minimum creep rate in the creep rupture-time chart as illustrated in FIG. 4 is noted. This is a proof of the fact that precipitation of a α" phase remarkably functions as creep resistance at a creep transition region and so much contributes to improvement of high temperature creep strength at 650° C. or higher. Further, with regard to the steel of the present invention, thickness of scale was 100 μm or thinner in every case and extremely stable steam oxidation resistance was obtained even over 630° C.

In the specimens Nos. 1 and 2, on the contrary, both creep rupture time and thickness of scale were much inferior to those of the steel of the present invention. Creep rate at 700° C. is extremely high and creep strength is also much inferior to that of the steel of the present invention.

It is confirmed from those results that, with regard to steel of the present invention, steam oxidation resistance is not deteriorated even at high temperature over 630° C. and that high temperature creep strength over 630° C. is extremely improved in comparison with the conventional steel.

TABLE 1

Chemical composition of specimens(wt %, the rest: Fe)

| No. | C | Si | Mn | P | S | Cr | Mo | W | Pd | Pt | V | Nb | B | N |
|---|---|---|---|---|---|---|---|---|---|---|---|---|---|---|
| 1 | 0.11 | 0.42 | 0.56 | 0.014 | 0.006 | 8.67 | 0.96 | — | — | — | 0.21 | 0.07 | — | 0.051 |
| 2 | 0.22 | 0.51 | 0.43 | 0.011 | 0.006 | 12.1 | 1.03 | 0.57 | — | — | 0.35 | — | — | 0.041 |
| 3 | 0.08 | 0.32 | 0.55 | 0.014 | 0.001 | 9.51 | — | 3.11 | 0.82 | — | 0.18 | 0.04 | 0.0025 | 0.044 |
| 4 | 0.16 | 0.05 | 0.31 | 0.008 | 0.001 | 11.2 | 0.15 | 2.64 | 1.23 | — | 0.22 | 0.03 | — | 0.0021 |
| 5 | 0.08 | 0.29 | 0.01 | 0.002 | 8E-04 | 8.43 | — | 3.23 | 2.31 | — | 0.2 | 0.07 | 0.0029 | 0.053 |
| 6 | 0.09 | 0.11 | — | 0.021 | 4E-04 | 9.22 | 0.43 | 2.11 | 0.52 | 0.88 | 0.31 | 0.05 | 0.0051 | 0.048 |
| 7 | 0.08 | 0.52 | 0.51 | 0.015 | 0.001 | 10.3 | 1.33 | 0.82 | 0.59 | — | 0.15 | 0.07 | 0.0042 | 0.025 |
| 8 | 0.11 | 0.44 | 0.55 | 0.014 | 0.001 | 9.83 | 0.25 | 2.51 | — | 1.52 | 0.24 | — | 0.0027 | 0.013 |
| 9 | 0.06 | 0.39 | 0.43 | 0.01 | 0.001 | 10.7 | — | 3.01 | 0.23 | — | 0.25 | 0.07 | 0.0051 | 0.082 |
| 10 | 0.09 | 0.36 | 0.22 | 0.009 | 0.003 | 9.13 | 0.41 | 2.55 | 0.44 | — | 0.24 | 0.06 | — | 0.003 |
| 11 | 0.1 | 0.5 | 0.61 | 0.025 | 0.001 | 8.98 | 1.27 | 0.81 | 0.17 | — | 0.21 | — | — | 0.0081 |
| 12 | 0.12 | 0.28 | 0.49 | 0.001 | 8E-04 | 9.54 | — | 2.88 | — | 0.41 | 0.39 | — | 0.0033 | 0.041 |
| 13 | 0.11 | 0.31 | 0.43 | 0.003 | 3E-04 | 9.21 | 0.05 | 3.03 | 0.14 | — | 0.21 | 0.07 | — | 0.028 |
| 14 | 0.09 | 0.47 | 0.55 | 0.005 | 0.001 | 10.4 | 0.51 | 2.34 | 0.35 | — | — | — | 0.0018 | 0.0055 |
| 15 | 0.14 | 0.31 | 0.62 | 0.001 | 0.001 | 12.7 | 1.02 | 1.25 | 0.81 | — | 0.26 | — | 0.0024 | 0.014 |
| 16 | 0.08 | 0.3 | 0.53 | 0.003 | 0.001 | 8.68 | 1.44 | 0.15 | 0.33 | 0.41 | 0.25 | — | 0.0022 | 0.045 |

TABLE 1-continued

| Chemical composition of specimens(wt %, the rest: Fe) | | | | | |
|---|---|---|---|---|---|
| No. | sol. Al | O | Others | W + 2Mo | Pd + (½)Pt |
| 1 | 0.012 | N/A | 0.06Ni | 1.92 | — |
| 2 | 0.021 | N/A | 0.15Ni | 2.63 | — |
| 3 | 0.001 | 0.005 | | 3.11 | 0.82 |
| 4 | — | 0.004 | 0.05Hf | 2.94 | 1.23 |
| 5 | — | N/A | | 3.23 | 2.31 |
| 6 | N/A | N/A | | 2.97 | 0.96 |
| 7 | 0.001 | N/A | | 3.48 | 0.59 |
| 8 | 0.013 | N/A | 0.10Ta | 3.01 | 0.76 |
| 9 | N/A | 0.004 | | 3.01 | 0.23 |
| 10 | N/A | N/A | 0.24Ni, 0.53Rh, 0.12Zr | 3.37 | 0.44 |
| 11 | 0.012 | N/A | 0.13Ga, 0.11Hf | 3.35 | 0.17 |
| 12 | 0.011 | 0.001 | 0.31In, 0.44Tl | 2.88 | 0.205 |
| 13 | — | 0.002 | 0.14Sm | 3.13 | 0.14 |
| 14 | 0.001 | 0.005 | 0.04Ce, 0.05Nd | 3.36 | 0.35 |
| 15 | 0.001 | 0.002 | 0.05Ta, 0.05Hf | 3.29 | 0.81 |
| 16 | 0.001 | 0.001 | 0.07Ta | 3.03 | 0.535 |
| | | | | ≦4.0 | 0.1~5.0 |

TABLE 2

| No. | Creep rupture time (h) 650° C., 120 MPa | Creep rupture time (h) 700° C., 120 MPa | Average thickness of scale (μm) 650° C. × 1000 h |
|---|---|---|---|
| 1 | 65 | 0.5 | 136 |
| 2 | 52 | 1.3 | 62 |
| 3 | 4527 | 105 | 38 |
| 4 | 3559 | 112 | 32 |
| 5 | 5043 | 121 | 11 |
| 6 | 3453 | 101 | 33 |
| 7 | 4212 | 133 | 37 |
| 8 | 4327 | 124 | 42 |
| 9 | 4625 | 118 | 35 |
| 10 | 5277 | 107 | 39 |
| 11 | 3292 | 120 | 34 |
| 12 | 4099 | 111 | 42 |
| 13 | 5139 | 202 | 46 |
| 14 | 3855 | 153 | 38 |
| 15 | 3612 | 171 | 8 |
| 16 | 5476 | 116 | 38 |

What is claimed is:

1. Heat resisting steel comprising a ferrite or tempered martensite structure, in which intermetallic compound phases having a $L1_0$ or $L1_2$ ordered structure are uniformly precipitated in ferrite or tempered martensite grains.

2. The heat resisting steel as claimed in claim 1, which includes, in chemical compositions, chromium(Cr) in amount of 8.0~15.0 wt % and at least one element selected from the group consisting of palladium(Pd) and platinum (Pt), the amount of which is regulated by Pd+(1/2)Pt and 0.1 wt %≦Pd+(1/2)Pt≦5.0 wt %.

3. The heat resisting steel as claimed in claim 2, wherein the heat resisting steel has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.01 wt % or less;

sol. (which means solubility in hydrochloric acid) aluminum(Al) in amount of 0.050 wt % or less;

at least one element selected from the group consisting of palladium(Pd) in amount of 0~5.0 wt % and platinum (Pt) in amount of 0~10.0 wt %, the amount of which is also regulated by Pd+(1/2)Pt and 0.1 wt %≦Pd+(1/2)Pt≦5.0 wt %; and the rest being iron(Fe) and inevitable impurities.

4. The heat resisting steel as claimed in claim 2, wherein the heat resisting steel has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of cobalt(Co) in amount of 0.1~1.5 wt %, nickel(Ni) in amount of 0.1~1.5 wt %, copper(Cu) in amount of 0.1~1.5 wt %, rhodium(Rh) in amount of 0.2~3.0 wt %, silver(Ag) in amount of 0.2~3.0 wt %, iridium(Ir) in amount 0.2~3.0 wt %, the amount of which is also regulated by Pd+(1/2)Pt+2Co+2Ni+2Cu+Rh+Ag+(1/2)Ir+(1/2)Au and 1.0 wt %≦Pd+(1/2)Pt+2Co+2Ni+2Cu+Rh+Ag+(1/2)Ir+(1/2)Au≦3.0 wt %; and the rest being iron(Fe) and inevitable impurities.

5. The heat resisting steel as claimed in claim 2, wherein the heat resisting steel has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of gallium(Ga) in amount of 0.05~1.0 wt %, indium(In) in amount of 0.1~1.5 wt %, and thallium(Tl) in amount of 0.2~3.0 wt %, the amount of which is also regulated by 2Ga+In+(1/2)Tl and 0.1 wt %≦2Ga+In+(1/2)Tl≦1.5 wt %; and the rest being iron(Fe) and inevitable impurities.

6. The heat resisting steel as claimed in claim 2, wherein the heat resisting steel has a chemical composition consisting essentially of carbon(C) in amount of 0.06~0.18 wt %;

silicon(Si) in amount of 0~1.0 wt %;

manganese(Mn) in amount of 0~1.5 wt %;

phosphorous(P) in amount of 0.030 wt % or less;

sulfur(S) in amount of 0.015 wt % or less;

chromium(Cr) in amount of 8.0~15.0 wt %;

tungsten(W) in amount of 0~4.0 wt % and molybdenum (Mo) in amount of 0~2.0 wt %, the amount of which is also regulated by W+2Mo and W+2Mo≦4.0 wt %;

vanadium(V) in amount of 0~0.50 wt %;

niobium(Nb) in amount of 0~0.15 wt %;

tantalum(Ta) in amount of 0~0.30 wt %;

titanium(Ti) in amount of 0~0.15 wt %;

zirconium(Zr) in amount of 0~0.30 wt %;

hafnium(Hf) in amount of 0~0.60 wt %;

nitrogen(N) in amount of 0~0.10 wt %;

boron(B) in amount of 0~0.030 wt %;

oxygen(O) in amount of 0.010 wt % or less;

sol. aluminum(Al) in amount of 0.050 wt % or less;

at least one element selected from the group consisting of palladium(Pd) in amount of 0~1.0 wt % and platinum (Pt) in amount of 0~2.0 wt %, the amount of which is also regulated by Pd+(1/2)Pt and 0.1 wt %≦Pd+(1/2)Pt≦1.0 wt %;

at least one element selected from the group consisting of cerium(Ce) in amount of 0.01~0.20 wt %, praseodymium(Pd) in amount of 0.01~0.20 wt %, neodymium(Nd) in amount of 0.01~0.20 wt %, promethium(Pm) in amount of 0.01~0.20 wt %, and samarium(Sm) in amount of 0.01~0.20 wt %, the amount of which is also regulated by Ce+Pr+Nd+Pm+Sm and 0.01 wt %≦Ce+Pr+Nd+Pm+Sm≦0.20 wt %; and the rest being iron(Fe) and inevitable impurities.

* * * * *